United States Patent [19]

Fellwock et al.

[11] Patent Number: 4,498,713

[45] Date of Patent: Feb. 12, 1985

[54] THERMAL STRESS RELIEF IN REFRIGERATORS

[75] Inventors: Louis W. Fellwock, Sebastian County, Ark.; Kenneth L. Hortin; Charles G. Fellwock, both of Scott Township, Vanderburg County, Ind.

[73] Assignee: Whirlpool Corporation, Benton Harbor, Mich.

[21] Appl. No.: 436,520

[22] Filed: Oct. 25, 1982

[51] Int. Cl.[3] ..... A47B 81/00

[52] U.S. Cl. ..... 312/214

[58] Field of Search ..... 312/213, 214; 220/435, 220/436, 440, 463; 52/573; 108/901

[56] References Cited

U.S. PATENT DOCUMENTS

| | | | |
|---|---|---|---|
| 1,919,366 | 7/1933 | Haines | 220/436 |
| 2,876,927 | 3/1959 | Henning . | |
| 3,363,796 | 9/1964 | Pringle . | |
| 3,406,858 | 10/1968 | Jackson . | |
| 3,813,137 | 5/1974 | Fellwock et al. . | |
| 3,858,409 | 1/1975 | Besing . | |
| 3,923,355 | 12/1975 | Dietterich | 312/214 |
| 3,940,195 | 2/1976 | Tillman . | |
| 3,944,111 | 3/1976 | Nonomague et al. . | |

*Primary Examiner*—William E. Lyddane
*Assistant Examiner*—Joseph Falk
*Attorney, Agent, or Firm*—Wood, Dalton, Phillips, Mason & Rowe

[57] ABSTRACT

A refrigeration apparatus having a plastic cabinet liner defining a refrigerated space and including a generally planar wall is located within a cabinet and spaced therefrom to receive foamed-in-place insulation. The planar wall of the liner has a first stress relief rib formed therein along with an interruption in the first stress relief rib. A second stress relief rib is formed in the planar wall and spaced from the first stress relief rib and has an extent generally parallel to the first rib at least equal to the length of the interruption. Thus, the first and second rib define a functionally continuous stress relief rib across the planar wall.

12 Claims, 5 Drawing Figures

THERMAL STRESS RELIEF IN REFRIGERATORS

BACKGROUND OF THE INVENTION

1. Field of the Invention

This invention relates to cabinet constructions for refrigeration apparatus, and more specifically, to the provision of means in such cabinets to provide thermal stress relief to avoid thermal stress cracking of cabinet components.

2. Background Art

Prior art of possible relevance includes the following U.S. Pat. Nos. 2,876,927 issued Mar. 10, 1959 to Henning; 3,363,796 issued Jan. 16, 1968 to Pringle; 3,406,858 issued Oct. 22, 1968 to Jackson; 3,813,137 issued May 28, 1974 to Fellwock et al; 3,858,409 issued Jan. 7, 1975 to Besing; 3,940,195 issued Feb. 24, 1976 to Tillman; and 3,944,111 issued Mar. 16, 1976 to Nonomaque et al.

The last several years have seen a considerable advancement in the art of insulation for refrigeration apparatus in terms of the increasing use of foamed-in-place insulation using, as for example, rigid polyurethane foam. Relatively thin layers of such foam provide excellent insulation and as a consequence, refrigerating equipment such as refrigerators, freezers, and refrigerator-freezer combinations, have been made with relatively small exterior cabinet dimensions as compared to their internal storage capacity.

Typically, an exterior cabinet is formed of metal and the storage space is defined by a thermoplastic liner of one piece construction received within the metal cabinet and spaced therefrom to define an insulating space receiving the foam. The foam and the plastic have different coefficients of thermal expansion and, inasmuch as typical insulating foams employed bond to the plastic liner, when the refrigerating apparatus is subjected to extreme temperature changes the respective thermal forces of expansion and contraction involved can cause the thermoplastic liner to crack, break or otherwise be damaged. Consequently, considerable care must be taken to avoid constructions wherein thermal stress buildup is sufficient to cause such damage. A number of the above-identified patents describe and illustrate approaches which seek to minimize a thermal stress problem, and the present invention is directed to overcoming a thermal stress problem.

SUMMARY OF THE INVENTION

It is a principal object of the invention to provide a new and improved thermal stress relief structure for use in a refrigerating apparatus. More particularly, it is an object of the invention to provide a new and improved thermal stress relief structure in a refrigerating system having a thermal stress relief rib which, for any of a variety of reasons, must be interrupted or formed in a discontinuous fashion.

An exemplary embodiment of the invention achieves the foregoing objects in a refrigerating apparatus having a plastic cabinet liner defining a refrigerated space. The liner includes a generally planar wall, and thermal stress relief means are provided and comprise a first stress relief rib formed on the planar wall and extending thereacross. Means define an interruption or discontinuity in the first stress relief rib and a second stress relief rib is formed in the planar wall and extends nontransversely to the first rib along the length of the interruption so that the first and second ribs define a functionally continuous stress relief rib across the planar wall.

In a preferred embodiment, the interruption is defined by the intersection of a channel-like depression formed in the planar wall which intersects the first stress relief rib.

The invention further contemplates that the first stress relief rib extend inwardly into the refrigerated space and that the second stress relief rib is directed oppositely therefrom.

In a highly preferred embodiment, both the channel and the second stress relief rib are adapted to receive refrigerating system components.

Other objects and advantages will become apparent from the following specification taken in connection with the accompanying drawings.

DESCRIPTION OF THE PREFERRED EMBODIMENT

Figure 1:
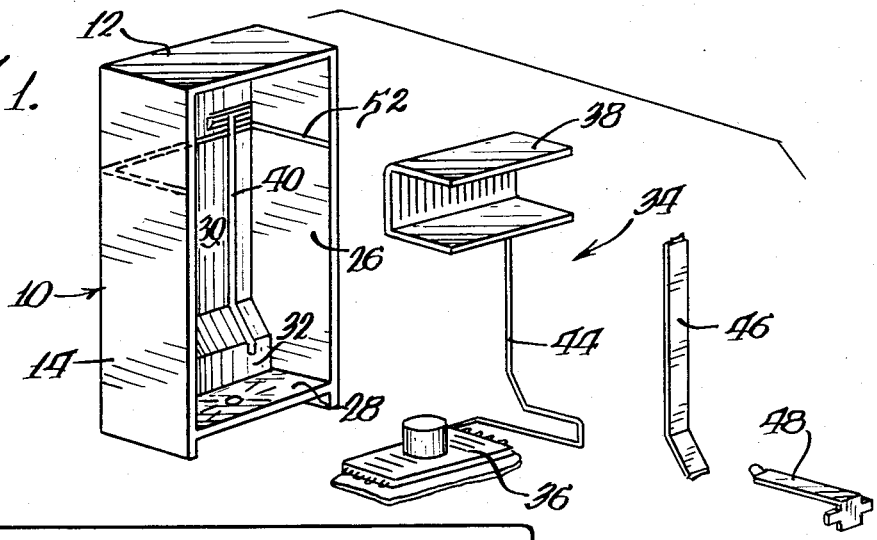
FIG. 1 is a somewhat schematic, exploded view of a refrigeration apparatus made according to the invention.
Figure 2:
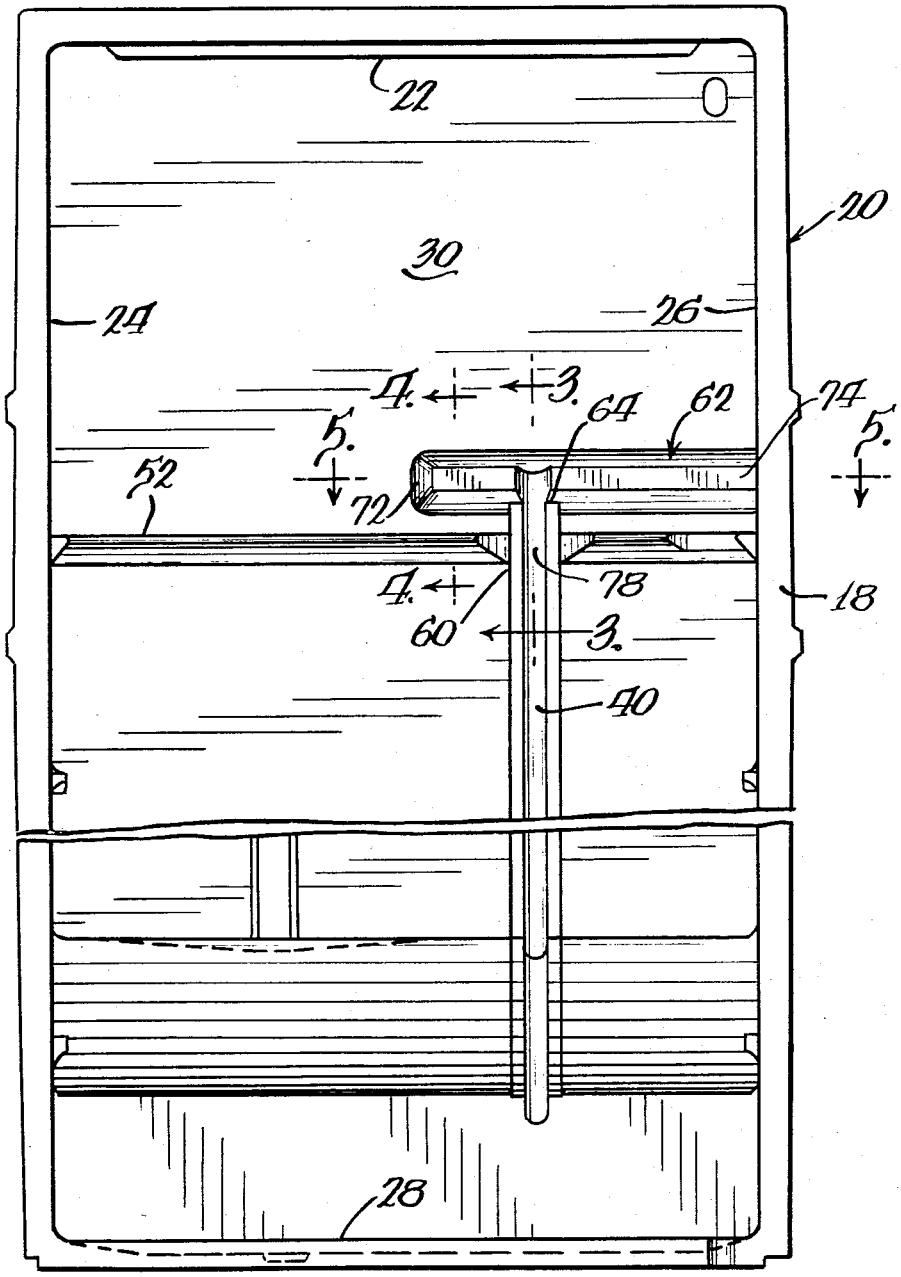
FIG. 2 is an enlarged, front elevation of the cabinet liner for the apparatus.

An exemplary embodiment of a refrigeration apparatus and a liner therefor made according to the invention is illustrated in the drawings and, with reference to FIGS. 1 and 2, is seen to include a metal outer cabinet, generally designated 10, of rectangular configuration and having a top wall 12, a side wall 14, and an additional side wall, a bottom wall, and a rear wall (not shown). Disposed within the cabinet 10 is a one piece thermoplastic liner, generally designated 20, which may be formed of acrylonitrile butadiene styrene copolymer or the like. The liner 20 includes a peripheral front flange 18, a top wall 22, side walls 24 and 26, a bottom wall 28 and a rear wall 30. In general, the side walls 24 and 26 along with the top wall 22 and the rear wall 30 will be generally planar, except for the lower portion 32 of the rear wall 30 which defines a housing for refrigerating system components or the like disposed below that portion of the liner.

Specifically, and as set forth in greater detail in the commonly assigned U.S. Pat. No. 3,858,409 identified previously, the disclosure of which is herein incorporated by reference, there is provided a refrigerating system, generally designated 34, including a compressor 36, an evaporator 38, and interconnecting tubing 44. Extending generally vertically within the rear wall 30 is a channel 40 in which the tubing 44 may be disposed and enclosed upon application of closures 46 and 48.

Figure 3:
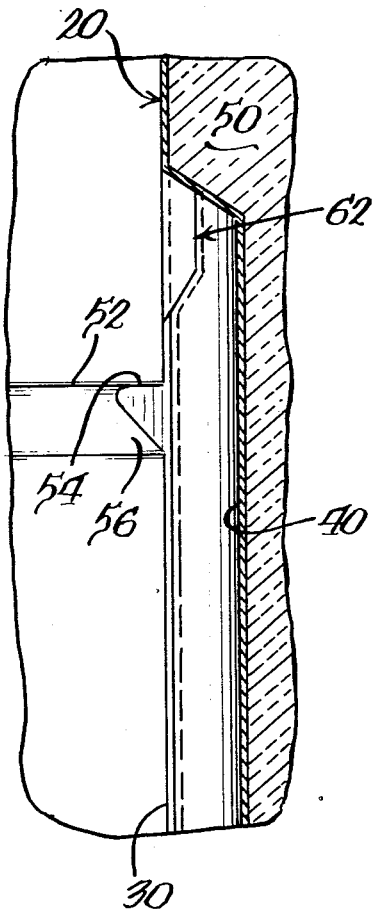
FIG. 3 is an enlarged, fragmentary sectional view taken approximately along the line 3—3 of FIG. 2.

Those skilled in the art will appreciate that the corresponding walls of the liner 30 are located inwardly of the corresponding walls of the cabinet 10 so as to define an insulation space therebetween. The insulation space thus defined is filled with insulation material, typically in the form of a foamed-in-place, rigid polyurethane foam, indicated at 50 in FIGS. 3–5. The foam 50 has a coefficient of thermal expansion differing from the coefficient of thermal expansion of the liner 20 and, in the typical case, the latter will be greater than the former. In any event, the nature of the materials typically employed is such that the foam 50 will bond to the liner 20 (except where provision is made to prevent such bonding in particular areas as is known in the art). As a consequence, large variations in temperature can cause generation of large thermal stresses. Large temperature variations are sometimes experienced during storage or shipment of a refrigeration apparatus and such variations may range from −30° F. to 140° F.

To prevent such thermal stresses from causing cracking or other damage to the liner 20, as seen in FIGS. 1 and 2, the side walls 24 and 26 and the rear wall 30 are provided with a stress relief rib 52 which extends inwardly into the refrigeration space defined by those walls together with the top and bottom walls 22 and 28 respectively. Where the refrigeration apparatus is to be employed as a combination refrigerator-freezer, the rib 52 may serve the additional function of providing an upwardly facing flat surface 54 which serves as a support for a compartment divider (not shown). The surface of the rib 52 opposite the surface 54, shown at 56, is preferably tapered. As a result of this construction, the rib 52 acts as a bellows-like structure which absorbs expansion and contraction due to temperature variations. Such of the foam 50 that flows into the interior of the rib 52, shown at 58 in FIG. 4, will frequently crack in a generally vertical plane coextensive with the plane of the liner wall in which the rib 52 is located thus allow relative movement between the two and yet not compromising the integrity of the main body of foam 50 forming the insulating layer.

A major difficulty occurs when the rib 52, for any of a variety of reasons, must be discontinuous. In the embodiment illustrated, the channel 40 for housing the conduit 44 extends through the rib 52 resulting in a discontinuity or interruption 60 at the point of intersection of the rib 52 and the channel 40. As a consequence, the flexing of the liner wall 30 at the rib 52 to absorb thermal stress is nonexistent at the interruption 60 resulting in the generation of high thermal stresses thereat which can lead to cracking or breaking or other destruction of the liner wall 30 in that area.

The present invention solves the foregoing difficulty by the provision of a second thermal stress relief rib, generally designated 62. The second rib 62, in the preferred embodiment, is spaced from the rib 52 and extends generally parallel with respect thereto. The rib 62 is located at the upper terminus 64 of the channel 40 and is such as to extend to either side of the interruption 60. Unlike the rib 52, the rib 62 does not extend into the refrigeration space, but rather, into the insulating space. This enables the rib 62 to perform a function in addition to stress relief to be described in greater detail hereinafter.

Figure 4:
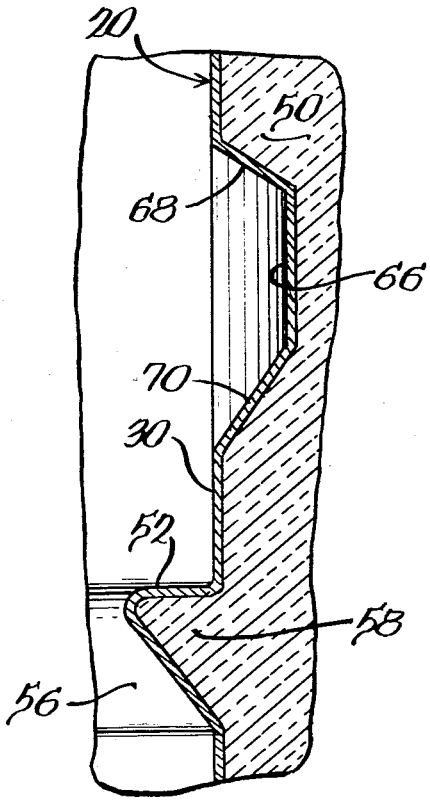
FIG. 4 is an enlarged, fragmentary sectional view taken approximately along the line 4—4 of FIG. 2.
Figure 5:
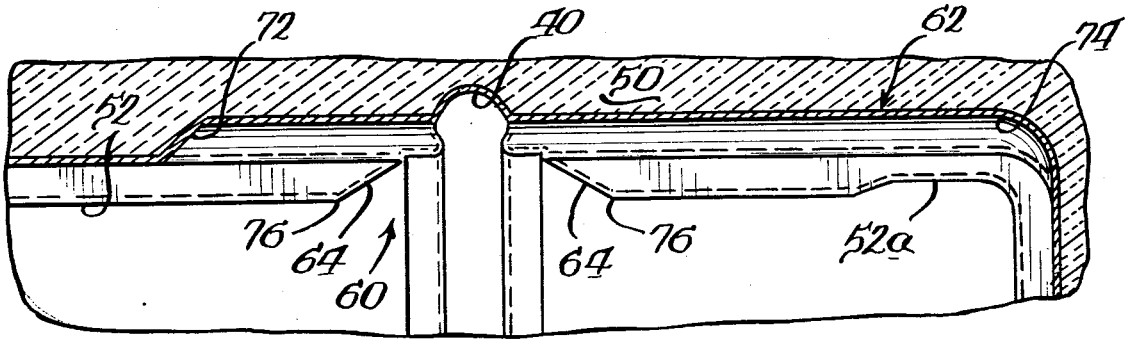
FIG. 5 is an enlarged, fragmentary horizontal section taken approximately along the line 5—5 of FIG. 2.

Referring to FIG. 5, it can be seen that in the area of the interruption 60, the rib 52 terminates in tapered end surfaces 64 which slope toward the channel 40. The use of such tapered surfaces enhances stress relief. With reference to FIGS. 2–5, inclusive, the rib 62 is seen to be in the form of a trough having a generally planar bottom 66 which is displaced from the plane of the wall in which it is formed, here the wall 30 of the liner 20. Opposed sides 68 and 70 of the trough interconnect the bottom 66 and the wall 30 and taper gradually from the bottom 66 to the wall 30 such that the trough is wider adjacent the wall 30 than at the bottom 66. Again, the tapering of the side walls 68 and 70 enhances stress relief. As best seen in FIG. 4, the taper of side wall 70 is longer, or more gradual, than that of side wall 68 so as to facilitate relative downward movement of liner wall 30 during thermal contraction.

As seen in FIG. 5, the trough defining the rib 62 includes a tapered end wall 72 and a curved wall 74 at the end opposite the end 72. The curved wall 74 serves the same function as a tapered wall and in both cases, the walls 72 and 74 enhance stress relief.

As can be best seen in FIG. 5, the end walls 72 and 74 are well to the sides of the tapered ends 64 of the rib 52 in the vicinity of the interruption 60. It is believed that the ends 72 and 74 must be such that the rib 62 extends at least to vertical planes encompassing the points of beginning 76 of the tapered ends 64 of the rib 52 to provide thermal stress relief. It is believed preferable that the ends 72 and 74 of the rib 62 extend beyond such vertical plane an even further distance. While no precise interrelationship has been determined, it has been determined that an excellent structure which avoids thermal stress cracking can be obtained if the following relationship is followed. One first determines a point, shown at 78 in FIG. 2, that defines the point of intersection of the center line of the rib 52 and the center line of the channel 40. The ends 72 and 74 of the rib 62 are then so located such that they extend to or beyond lines extending along liner wall 30 from the point 78 at a 45° angle to the center line of the rib 52. In the illustrated embodiment the right-hand end 74 of rib 62 has been located well beyond the region defined by such a 45° line from point 78 so as to provide additional stress relief adjacent a shallow portion **52*a* of rib 52**.

As mentioned previously, the rib 62 is directed into the insulation space so as to provide a function in addition to stress relief. By reason of the rib 62 being located at the upper terminus 64 of the channel 40, the structure permits components of the refrigeration system 34 to be received in the rib 62. For example, a horizontal run of the conduit 44 (not shown) located behind the evaporator 38 may be disposed within the rib 62. Similarly, connecting fittings may be disposed within the rib 62. Such a construction maximizes the space available to house the evaporator 38. However, where such a storage function is not of concern, the rib 62 could be directed into the refrigeration space if desired.

The use of the additional rib 62 provides a structure wherein the rib 62 combines with the rib 52 to provide a functionally continuous stress relief rib where the principal rib 52 must be interrupted for any reason. Consequently, thermal stresses that would normally arise in the area of the interruption or discontinuity in the principal rib 52 and which could lead to cracking or breaking of the liner 20 in the vicinity of the interruption 60 are absorbed by the rib 62 and dissipated.

Furthermore, in many instances, the additional rib 62 may be configured so as to partially house system components to maximize the space available for that purpose.

We claim:

1. In a refrigeration apparatus having a cabinet, a plastic cabinet liner within the cabinet and defining a refrigerated space with the liner including a generally planar wall, and insulation disposed between said liner and said cabinet and having a coefficient of thermal expansion different from that of said liner, thermal stress relief means for said liner comprising:

a first stress relief rib formed in said wall member and extending thereacross;

means defining an interruption in said first stress relief rib; and a second stress relief rib formed in said wall member and extending generally parallel to said first rib and across said interruption, whereby said first and second ribs define an effectively continuous stress relief rib across said wall member.

2. In a refrigeration apparatus having a cabinet, a plastic cabinet liner within the cabinet and defining a refrigerated space and including a generally planar wall member having a channel-like depression formed therein, a refrigeration system component in said depression, and a body of insulation between said cabinet and said liner and having a coefficient of thermal expansion different from that of said liner, thermal stress relief for said liner means comprising:

a first stress relief rib formed in said wall member and extending generally thereacross, said depression intersecting and defining an interruption in said first rib; and a second stress relief rib formed in said wall member and extending generally parallel to said first rib along the length of said interruption, whereby said first and second ribs define an effectively continuous stress relief rib across said wall member.

3. The refrigeration apparatus liner of claim 2 wherein said second stress relief rib comprises a second channel-like depression formed integrally with and connected to said first defined channel-like depression.

4. The refrigeration apparatus cabinet liner of claim 2 wherein said wall member has a length greater than its width and said stress relief means extends across the width of said wall member.

5. In a refrigeration apparatus having an outer cabinet defining generally planar side, top, bottom and rear walls and a one-piece thermoplastic inner liner nested within said outer cabinet and defining generally planar side, top, bottom and rear wall members corresponding to said cabinet walls and defining an insulation space therebetween, and wherein one of said liner wall members includes a generally vertical channel-like depression formed therein and extending outwardly into said insulation space, stress relief means for said liner comprising:

a generally horizontal, inwardly extending stress relief rib formed in said one liner wall member and extending thereacross, said rib being intersected by said channel-like depression so as to define an interrupted portion of said rib, said rib having end portions which taper gradually toward said interrupted portion on each side thereof; and a generally horizontal, outwardly extending stress relief rib formed in said one liner wall member and extending transversely from the upper portion of said channel-like depression, said outwardly extending rib being generally parallel and adjacent to said inwardly extending rib and extending across said interruption whereby said inwardly and outwardly extending ribs define a substantially continuous stress relief rib across said one liner wall member.

6. The refrigeration apparatus of claim 5 wherein said outwardly extending stress relief rib includes a bottom wall which slopes gradually toward said one liner wall member.

7. In a refrigeration apparatus having an outer cabinet and a one piece thermoplastic liner within the outer cabinet having generally planar side and rear walls spaced from said cabinet to define an insulation space therebetween, a body of insulation foam in said insulation space and having a coefficient of thermal expansion different from the coefficient of thermal expansion of said thermoplastic liner, and wherein one of said liner walls includes a generally vertical channel-like depression extending into said insulation space, thermal stress relief means for said liner comprising:

a first generally horizontal stress relief rib formed in said one liner wall member and extending substantially thereacross, said first stress relief rib being directed away from said insulation space and being intersected by said channel-like depression thereby forming an interruption in said first stress relief rib;

a second generally horizontal stress relief rib formed in said one liner wall spaced from said first stress relief rib and extending generally parallel thereto, said second horizontal stress relief rib being located at a terminus of said channel-like depression and extending into said insulation space, said second stress relief rib extending to either side of said channel-like depression so as to, together with said first stress relief rib, define a functionally continuous stress relief rib across said one liner wall.

8. The refrigeration apparatus of claim 7 further including a refrigeration system compressor within said cabinet, an evaporator within said cabinet and spaced from said compressor, and conduit means disposed within said channel-like depression and interconnecting said compressor and said evaporator, said second stress relief rib further serving as a recess to receive a portion of said refrigeration system.

9. The refrigeration apparatus of claim 7 wherein said first stress relief rib is horizontally tapered to gradually merge into said interruption, and said second stress relief rib is defined by a trough having a bottom displaced from the plane of said one liner wall and sides interconnecting said bottom and said one liner wall, said trough sides tapering gradually from said bottom towards said one liner wall such that said trough is wider adjacent said one liner wall than at said bottom.

10. The refrigeration apparatus of claim 9 wherein one of said sides of said second stress relief rib faces generally in the direction along which said liner moves during thermal contraction and said one side has a taper which is more gradual than the taper of the other of said sides.

11. In a refrigeration apparatus having a cabinet, a plastic cabinet liner within the cabinet and defining a refrigerated space with the liner including a generally planar wall, and insulation disposed between said liner and said cabinet and having a coefficient of thermal expansion different from that of said liner, thermal stress relief means for said liner comprising:

a first stress relief rib formed in said planar wall and extending substantially hereacross;

means receiving at least one component of said refrigeration apparatus and defining an interruption in said first stress relief rib; and a second stress relief rib formed in said planar wall and spaced from said first stress relief rib, said second stress relief rib extending to either side of said interruption so that said first and second stress relief ribs define a functionally continuous stress relief rib extending across said planar wall.

12. The refrigeration apparatus of claim 11 wherein said component is a refrigeration system component of said refrigeration apparatus and wherein said second stress relief rib further functions to receive and at least partially house at least one component of said refrigeration system.

* * * * *